US007172845B2

(12) United States Patent
Sato et al.

(10) Patent No.: US 7,172,845 B2
(45) Date of Patent: Feb. 6, 2007

(54) DEVELOPING AGENT AND IMAGE FORMING APPARATUS USING THE SAME

(75) Inventors: Shuitsu Sato, Tokyo (JP); Takashi Urabe, Shizuoka-ken (JP); Yasuhito Noda, Mishima (JP); Takahito Kabai, Mishima (JP); Yuichi Hori, Mishima (JP); Taishi Takano, Shizuoka-ken (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 226 days.

(21) Appl. No.: 10/786,168

(22) Filed: Feb. 26, 2004

(65) Prior Publication Data

US 2004/0224246 A1 Nov. 11, 2004

(30) Foreign Application Priority Data

Feb. 28, 2003 (JP) ..... 2003-054325

(51) Int. Cl.
*G03G 9/06* (2006.01)

(52) U.S. Cl. ..... 430/109.4; 430/108.4; 399/159

(58) Field of Classification Search ..... 430/109.4, 430/108.1, 108.4, 108.8, 111.35; 399/159
See application file for complete search history.

(56) References Cited

U.S. PATENT DOCUMENTS

| | | | | |
|---|---|---|---|---|
| 5,879,848 | A * | 3/1999 | Kurose et al. | 430/107.1 |
| 6,541,173 | B1 * | 4/2003 | Kido et al. | 430/109.4 |
| 2003/0165765 | A1 * | 9/2003 | Yamashita et al. | 430/111.1 |
| 2004/0048182 | A1 * | 3/2004 | Urabe | 430/110.2 |

FOREIGN PATENT DOCUMENTS

| | | | |
|---|---|---|---|
| JP | 8-106173 | A | 4/1996 |
| JP | 2002-268417 | A | 9/2002 |

* cited by examiner

*Primary Examiner*—John L Goodrow
(74) *Attorney, Agent, or Firm*—Foley & Lardner LLP

(57) ABSTRACT

Of developing agents each having a binder containing a polyester resin having an acidic value, wax having a softening point higher than that of the binder, and wax having a softening point lower than that of the binder, the acidic value of a black developing agent is made higher than that of a color developing agent.

22 Claims, 2 Drawing Sheets

DEVELOPING AGENT AND IMAGE FORMING APPARATUS USING THE SAME

CROSS-REFERENCE TO RELATED APPLICATIONS

This application is based upon and claims the benefit of priority from the prior Japanese Patent Application No. 2003-054325, filed Feb. 28, 2003, the entire contents of which are incorporated herein by reference.

BACKGROUND OF THE INVENTION

1. Field of the Invention

The present invention relates to an image forming apparatus for developing an electrostatic charge image and magnetic latent image in, e.g., an electrophotographic method, electrostatic printing method, and magnetic recording method, and a developing agent for use in this image forming apparatus; and, more particularly, to an image forming apparatus using a heat fixing system such as heated roller fixing, and a developing agent for use in this image forming apparatus.

2. Description of the Related Art

An electrophotographic method generally uses a photoconductive material to form an electrostatic latent image on a photoreseptor by using various means. This electrostatic latent image is developed using a developing agent, and the developing agent image is transferred onto a transfer medium such as a paper sheet where necessary. A copied image is obtained by fixing the transferred image by, e.g., heat, pressure, heat and pressure, or solvent vapor. The developing agent not transferred but remaining on the photoreseptor after the formation of the copied image is removed by various methods, and the above process is repeated.

Recently, such an image forming apparatus for forming a copied image is being strictly required to exhibit decreased size and weight, reduced power consumption, and high reliability. As a consequence, the performance required of the developing agent is also advancing.

In a heat fixing system which performs fixing via a heating roller or film in the fixing process, the surface of the heating roller or fixing film is formed by using a material which imparts releasability to a developing agent, and fixing is performed by moving a transfer medium such that the surface of the material is in contact with the surface of the roller or film. In this method, the thermal efficiency when the developing agent image is fused on the transfer medium is very high because the surface of the heating roller or fixing film is in contact with the surface of the transfer medium, so the image is rapidly fixed. In this heat fixing method, however, the surface of the heating roller for fixing film is in contact with the developing agent image in a molten state. Therefore, a portion of the developing agent image sometimes adheres and transfers to the surface of the heating roller or fixing film, and then transfers to the subsequent transfer medium to cause a so-called offset phenomenon, thereby contaminating a fixing sheet. Accordingly, one problem to be solved of this heat fixing method is to prevent adhesion of the developing agent to the surface of the heating roller or fixing film.

In a heated roller fixing system which performs heat fixing by using a heating roller, various attempts for reducing the fixing energy have been made as recent energy-saving measures. As a method of reducing the fixing energy, various attempts have been made to reduce the quantity of heat (heat capacity) of the heating roller itself, thereby reducing the time before heat accumulation and increasing the heat transfer efficiency. More specifically, decreasing the thickness of the core metal of the heating roller eliminates the need for a large amount of heat and reduces the heat capacity. However, when a heating roller having a thin core metal is used, the temperature of the roller surface significantly decreases when a paper sheet passes by because the heat capacity of the heating roller is low. Accordingly, it is necessary to maintain the roller surface at a predetermined temperature by continuously heating the heating roller by a heating member, thereby replenishing the heat deprived of by the passing paper.

A developing agent for use in a fixing apparatus including the heating roller as described above is required to have good adhesion, i.e., good fixing properties with respect to a transfer medium over a broad temperature range.

Conventionally, to prevent adhesion of toner to the surface of the heating roller, the roller surface is formed by using a material, e.g., silicone rubber or fluorine-based resin, having high releasability to the toner. In addition, to prevent offset and fatigue of the roller surface, the roller surface is coated with a liquid having high releasability, such as silicone oil.

This silicone oil coating is very effective to prevent offset of the developing agent. However, an apparatus for supplying the silicone oil is additionally required, and the fixing apparatus becomes complicated. Also, if the silicone oil evaporates by heat, the interior of the machine is contaminated.

On the other hand, to supply a highly releasable material from the developing agent without supplying any silicone oil, a method of adding a releasing agent such as low-molecular-weight polyethylene or low-molecular-weight polypropylene to the developing agent is proposed. However, if a large amount of releasing agent is added to achieve a satisfactory effect, filming to the photoreseptor, contamination of the developing roller surface, or the like occurs, and this degrades the image.

To avoid this, a small amount of releasing agent by which no image degradation occurs is added to toner, and at the same time a slight amount of releasing oil is supplied or an apparatus which removes offset developing agent by using a winding type member, e.g., a web is used.

A developing agent to which wax is added as a releasing agent is also known. This wax is used to increase the offset resistance when toner is at lower temperatures or high temperatures, and improve the fixing properties at low temperatures. Unfortunately, the wax worsens the blocking resistance against the developing agent, or worsens the developing properties when heated by a temperature rise of a copying machine or the like. Also, when left to stand for long periods, the wax blooms to worsen the developing properties.

In addition, Jpn. Pat. Appln. KOKAI Publication No. 8-106173 discloses a developing agent which uses a combination of wax and a predetermined binder resin, e.g., a resin having an acid value, in order to improve the low-temperature fixing properties and the offset resistance.

As described above, conventional developing agents are superior in high-temperature offset and developing properties but inferior in low-temperature fixing properties, or superior in low-temperature offset and low-temperature fixing properties but inferior in blocking resistance. Also, the developing properties worsen with a temperature rise in the machine, and low-temperature and high-temperature offset resistances cannot be achieved at the same time.

BRIEF SUMMARY OF THE INVENTION

The present invention has been made in consideration of the above situation, and has as its first object to provide a developing agent having good low-temperature fixing properties, a high offset resistance, and a high smear resistance.

It is a second object of the present invention to provide an image forming apparatus capable of forming an image having good low-temperature fixing properties, a high offset resistance, and a high smear resistance.

First, the present invention provides a developing agent to perform black development, which is used in combination with a color developing agent containing toner particles having a chromatic coloring material, a first binder resin containing a polyester resin having a first acidic value, wax having a softening point higher than a softening point of the first binder resin, and wax having a softening point lower than the softening point of the first binder resin, and which contains toner particles having a black coloring material, a second binder resin containing a polyester resin having a second acidic value higher than the first acidic value, wax having a softening point higher than a softening point of the second binder resin, and wax having a softening point lower than the softening point of the second binder resin.

Second, the present invention provides a developing agent to perform color development, which contains toner particles having a chromatic coloring material, a first binder resin containing a polyester resin having a first acidic value, wax having a softening point higher than a softening point of the first binder resin, and wax having a softening point lower than the softening point of the first binder resin, and which is used in combination with a black developing agent containing toner particles having a black coloring material, a second binder resin containing a polyester resin having a second acidic value higher than the first acidic value, wax having a softening point higher than a softening point of the second binder resin, and wax having a softening point lower than the softening point of the second binder resin.

Third, the present invention provides an image forming apparatus comprising a developing unit which opposes an image carrier, which stores a color developing agent containing toner particles having a chromatic coloring material, a first binder resin containing a polyester resin having a first acidic value, wax having a softening point higher than a softening point of the first binder resin, and wax having a softening point lower than the softening point of the first binder resin, and a black developing agent containing toner particles having a black coloring material, a second binder resin containing a polyester resin having a second acidic value higher than the first acidic value, wax having a softening point higher than a softening point of the second binder resin, and wax having a softening point lower than the softening point of the second binder resin, and which forms a developing agent image by developing an electrostatic latent image formed on the image carrier, a transfer unit to transfer the developing agent image onto a transfer medium, and a fixing unit which has a heating roller, a peeling roller separated from the heating roller, a fixing belt looped between the heating roller and peeling roller, and a pressure roller capable of pressing the heating roller via the fixing belt, and which forms an image by fixing the transferred developing agent image onto the transfer medium.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE INVENTION

Figure 1:
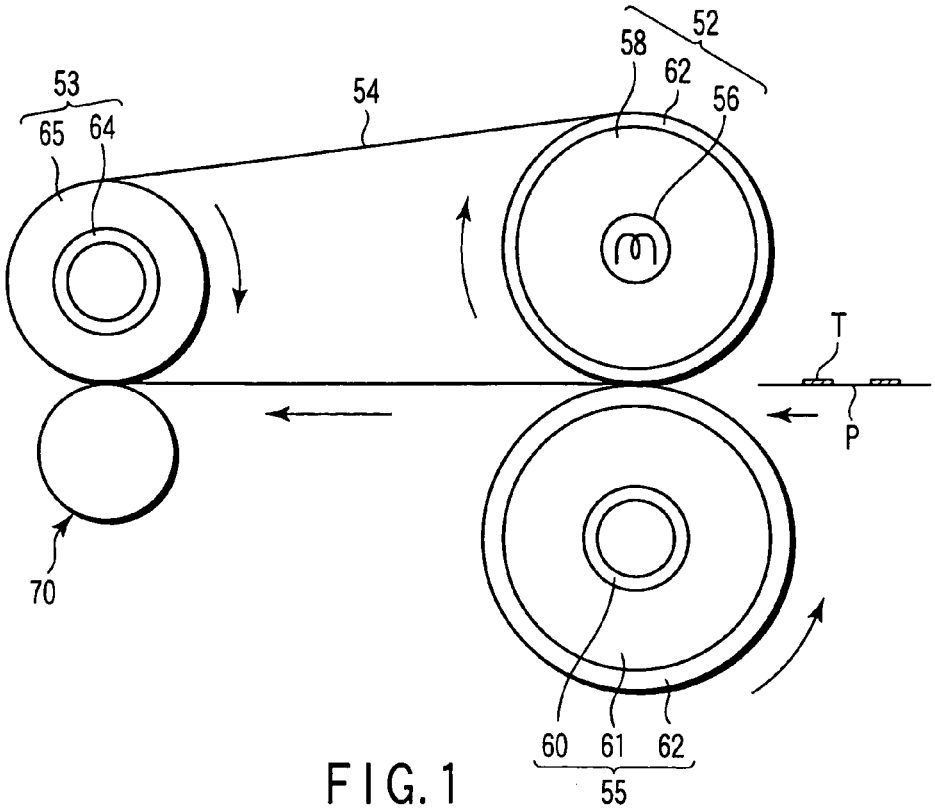
FIG. 1 is a view showing an example of a fixing apparatus which is favorably used in the present invention and includes a fixing belt.

The present invention includes inventions according to the following three aspects.

The invention according to the first aspect provides a developing agent for black development, which is used in combination with a predetermined color developing agent.

The invention according to the second aspect provides a developing agent for color development, which is used in combination with a predetermined black developing agent.

The invention according to the third aspect provides an image forming apparatus which uses the above-mentioned developing agents for color development and black development in combination with a predetermined fixing device.

The color developing agent used in the present invention contains toner particles having a chromatic coloring material, a first binder resin containing a polyester resin having a first acidic value, wax having a softening point higher than a softening point of the first binder resin, and wax having a softening point lower than the softening point of the first binder resin.

The black developing agent used in the present invention contains toner particles having a black coloring material, a second binder resin containing a polyester resin having a second acidic value higher than the first acidic value, wax having a softening point higher than a softening point of the second binder resin, and wax having a softening point lower than the softening point of the second binder resin.

In the present invention, the black developing agent is a so-called monochromatic developing agent. The color developing agent is used to generate a single color or a desired color by color mixing in color image formation. The color developing agent is a developing agent selected from developing agents having colors other than black, e.g., yellow, magenta, and cyan, or a combination of two or more of these developing agents.

In the present invention, the acid value of the polyester resin used in the color developing agent is made higher than that of the polyester resin used in the black developing agent. This eliminates a difference between the resistance values of the black developing agent and color developing agent, which is caused by the difference between the conductivity of carbon black contained as a coloring material in the black developing agent and the insulation properties of a color pigment or the like contained as a coloring agent in the color developing agent, and hence eliminates a difference between their charging characteristics. Consequently, the black developing agent and color developing agent exhibit uniform charging characteristics, so uniform image quality can be obtained. In addition, the life of the black developing agent can be made longer than that of the color developing agent.

Also, in the present invention, wax having a melting point higher than the softening point of the binder resin and wax having a melting point lower than that are combined. Accordingly, the wax having the lower melting point achieves a plasticizing action, and the wax having the higher melting point achieves an effect on a releasing action. As a consequence, the wax having the lower melting point contributes to the low-temperature fixing properties of toner, and the wax having the higher melting point contributes to the high-temperature offset resistance.

As described above, the present invention can form a high-quality image having stable charging characteristics and good fixing properties, and free of offset and smear.

The polyester resin used in the present invention is obtained by using a monomer containing a multivalent alcohol component and a multivalent carboxylic acid component such as carboxylic acid, carboxylic acid anhydride, or carboxylate.

Examples of the multivalent alcohol component are alkylene (number of carbon atoms 2 to 3) oxide (average number of added moles 1 to 10) adducts of bisphenol A, e.g., polyoxypropylene(2,2)-2,2-bis(4-hydroxyphenyl)propane and polyoxyethylene(2,2)-2,2-bis(4-hydroxyphenyl)propane; ethyleneglycol, propyleneglycol, neopentylglycol, glycerin, pentaerythritol, trimethylolpropane, hydrogenated bisphenol A, sorbitol, and alkylene (number of carbon atoms 2 to 3) oxide (average number of added moles 1 to 10) adducts of these components. One or more of these components are preferably contained.

Examples of the multivalent carboxylic acid component are dicarboxylic acids such as phthalic acid, isophthalic acid, terephthalic acid, fumaric acid, and maleic acid, succinic acids substituted by a 1- to 20-carbon alkyl group or 2- to 20-carbon alkenyl group, such as dodecenyl succinic acid and octyl succinic acid, trimellitic acid, pyromellitic acid, anhydrides of these acids, and alkyl (number of carbon atoms 1 to 8) esters of these acids. One or more of these components are preferably contained.

Examples of an aromatic compound favorable as a material monomer are trimellitic acid and its derivative, isophthalic acid and its derivative, terephthalic acid and its derivative, an alkylene oxide adduct of bisphenol A, phenylenediamine, and xylylenediamine.

The polyester resin used in the present invention preferably has a softening point of 100 to 150° C. If the softening point is lower than 100° C., the shelf stability often worsens although the fixing properties are good. If the softening point is higher than 150° C., the energy required for fixing increases, and this often lowers the fixing strength. The softening point of the polyester resin can be adjusted by appropriately mixing a polyester resin having a low softening point and a polyester resin having a high softening point.

As described previously, the polyester resins used in the black developing agent and color developing agent of the present invention have different acidic values; the acidic value of the resin used in the black developing agent is higher than that of the resin used in the color developing agent. The acidic value of the resin for the black developing agent is preferably 12 to 29 KOHmg/g, and that of the color developing agent is preferably 6 to 12 KOHmg/g. If the acidic value of the resin for the black developing agent is less than 12 KOHmg/g, the fixing properties often become worse than those of the color developing agent. If this acidic value exceeds 29 KOHmg/g, the charging characteristics when images are continuously output often become unstable, or the environmental difference between charging characteristics tends to increase. If the acidic value of the resin for the color developing agent is less than 6 KOHmg/g, the difference from the fixing properties of the black developing agent increases too much, and this often causes uneven fixing. If this acidic value exceeds 12 KOHmg/g, the charging characteristics when images are continuously output often become unstable, or the environmental difference between charging characteristics tends to increase. Consequently, the development amount changes, and this often varies the color reproducibility or glossiness.

Also, the polyester resins used in the black developing agent and color developing agent of the present invention preferably have different molecular weights. The molecular weight of the resin used in the black developing agent is preferably lower than that of the resin used in the color developing agent. More preferably, the polyester resin for the black developing agent has a weight-average molecular weight of 5,000 to 60,000, and that for the color developing agent has a weight-average molecular weight of 5,000 to 90,000. Most preferably, the polyester resin for the black developing agent has a number-average molecular weight of 2,000 to 4,000, and that for the color developing agent has a number-average molecular weight of 2,000 to 5,000.

The amount of black developing agent sticking to a transfer medium per unit area is, e.g., about 0.5 mg/cm$^2$. However, when yellow, magenta, and cyan developing agents are overlaid, the amount of these color developing agents sticking to a transfer medium per unit area is about 1.6 mg/cm$^2$, i.e., the amount of color developing agents is three times that of black developing agent or more. This makes the quantity of heat required for fixing of the black developing agent different from that required for fixing of the color developing agents. Accordingly, the printing speed in black mode can be made higher than that in color mode. In the present invention, the molecular weight of the polyester resin used in the black developing agent is made lower than that of the polyester resin used in the color developing agent, thereby improving the fixing properties of the black developing agent. This makes the printing speed in black mode higher.

The developing agent of the present invention contains at least two types of wax, i.e., first wax having a melting point higher than the softening point of the polyester resin, and second wax having a melting point lower than the softening point of the polyester resin.

Examples of the wax are aliphatic hydrocarbon-based wax such as low-molecular-weight polyethylene, low-molecular-weight polypropylene, polyolefin copolymer, polyolefin wax, microcrystalline wax, paraffin wax, and Fischer-Tropsch wax, oxides of aliphatic hydrocarbon-based wax such as polyethylene oxide wax, block copolymers of these waxes, vegetable wax such as candelilla wax, carnauba wax, Japan wax, jojoba wax, and rice wax, animal wax such as beeswax, lanolin, and spermaceti wax, mineral wax such as ozocerite, ceresin, and petrolatum, wax containing fatty ester as an acid component, such as montanic acid ester wax and castor wax, and wax obtained by partially or entirely deoxidizing fatty acid ester, such as deoxidized carnauba wax. Other examples are saturated straight-chain fatty acids such as palmitic acid, stearic acid, montanic acid, and long-chain alkylcarboxylic acid containing an alkyl group having a longer chain, unsaturated fatty acids such as brassidic acid, eleostearic acid, and parinaric acid, saturated alcohols such as stearyl alcohol, eicosyl alcohol, behenyl alcohol, carnaubyl alcohol, ceryl alcohol, melissyl alcohol, and long-chain alkyl alcohol containing an alkyl group having a longer chain, multivalent alcohol such as sorbitol, fatty acid amides such as linoleic acid amide, oleic acid amide, and lauric acid amide, saturated fatty acid bisamides such as methylenebisstearic acid amide, ethylenebiscapric acid amide, ethylenebislauric acid amide, and hexamethylenebisstearic acid amide, unsaturated fatty acid amides such as ethylenebisoleic acid amide, hexamethylenebisoleic acid amide, N,N'-dioleyladipic acid amide, and N,N'-dioleylsebacic acid amide, aromatic bisamides such as m-xylenebisstearic acid amide and N,N'-distearylisophthalic acid amide, fatty acid metal salts (so-called metallic soap) such as calcium stearate, calcium laurate, zinc stearate, and magnesium stearate, wax obtained by grafting aliphatic hydrocarbon-based wax by using a vinyl-based monomer such as styrene or acrylic acid, a partially esterified product of fatty acid such as monoglycerid behenate and multivalent alcohol, and a methylester compound obtained by hydrogenating vegetable oil and having a hydroxyl group.

Examples of the wax having a melting point higher than the softening point of the polyester resin are high-density, low-molecular-weight polyethylene (softening point 124 to 133° C.) and low-molecular-weight polypropylene (softening point 145 to 164° C.)

Examples of the wax having a melting point lower than the softening point of the polyester resin are vegetable wax and animal wax such as candelilla wax (71° C.), carnauba wax (83° C.), rice wax (79° C.), jojoba oil (95° C.), white Japan wax (53° C.), and beeswax (64° C.), aliphatic hydrocarbon-based wax such as paraffin wax (80 to 107° C.), long-chain ester wax (90 to 95° C.), fatty acid ester wax (60 to 82° C.), an acidic group (73° C.), a fatty acid metal salt such as zinc stearate (123° C.), montan wax (79 to 89° C.), montanic acid ester wax (56 to 92° C.), and low-density, low-molecular-weight polyethylene (103 to 124° C.).

The wax having a melting point higher than the softening point of the polyester resin and/or the wax having a melting point lower than the softening point of the polyester resin can be desolvated when added in an amount of 0.1 to 8 parts by weight with respect to 100 parts by weight of the resin solid component in the solution while the polyester resin is polymerized. The wax added in this way improves in dispersibility.

Of the coloring materials, examples of the monochromatic coloring material are as follows. Red: Permanent Red, Brilliant Carmine 6B, Rhodamine Lake Blue: phthalocyanine blue, alkali blue, Fast Sky Blue Green: Malachite Green, pigment green, chrome green Examples of the yellow coloring material for full-color images are C.I.pigment Yellow 1 Symuler Fast Yellow GH (Dainippon Ink & Chemicals), C.I.pigment Yellow 3 Symuler Fast Yellow 10GH (Dainippon Ink & Chemicals), C.I.pigment Yellow 12 Symuler Fast Yellow GF (Dainippon Ink & Chemicals), C.I.pigment Yellow 13 Symuler Fast Yellow GRF (Dainippon Ink & Chemicals), C.I.pigment Yellow 14 Symuler Fast Yellow 5GR (Dainippon Ink & Chemicals), and C.I.pigment Yellow 17 Symuler Fast Yellow 8GR (Dainippon Ink & Chemicals). Examples of C.I.pigment Yellow 12 are Yellow 152 (Arimoto Chemistry. Co.), Pigment Yellow GRT (Sanyo Color Works, Ltd.), Sumika Print Yellow ST-O (Sumitomo Chemical), Benzidine Yellow 1316 (Noma Kaatsu), Seika Fast Yellow 2300 (Dainichiseika Color & Chemicals Mfg.), Lyonol Yellow GRT (Toyo Ink Mfg.), C.I.pigment Yellow 180, and Toner Yellow HG (Clariant (Japan) KK).

Examples of the magenta coloring material for full-color images are C.I.pigment Red 81 Symuler Rhodamine Y Toner F (Dainippon Ink & Chemicals), C.I.pigment Red 122, C.I.pigment Red 57 Symuler Brill Carmine 6B (Dainippon Ink & Chemicals), C.I.pigment Red 22 Symuler Fast Brill Scarlet BG (Dainippon Ink & Chemicals), C.I.pigment Red 21 Sanyo Fast Red GR (Sanyo Color Works, Ltd.), C.I.pigment Red 18 Sanyo Toluid neNaroom Medium (Sanyo Color Works, Ltd.), C.I.pigment Red 114 Symuler Fast Carmine BS (Dainippon Ink & Chemicals), C.I.pigment Red 112 Symuler Fast Red FGR (Dainippon Ink & Chemicals), and C.I.pigment Red 5 Symuler Fast Carmine FB (Dainippon Ink & Chemicals).

Examples of the cyan coloring material for full-color images are C.I.pigment Blue 15 Fastogen Blue GS (Dainippon Ink & Chemicals), Chromofine SR (Dainichiseika Color & Chemicals Mfg.), C.I.pigment Blue 16 Sumitone Cyanine Blue LG (Sumitomo Chemical Co., Ltd.), C.I.pigment Green 7 phthalocyanine Green (Tokyo Printing Ink Mfg.), C.I.pigment Green 36 Cyanine Green 2YL (TOYO INK MFG.), and C.I.pigment Blue 15:3 Cyanine Blue GGK (Nippon Pigment).

Examples of the black coloring material are carbon black, spirit black, and aniline black (C.I.pigment Black 1).

The addition amount of coloring material is preferably 0.1 to 15 parts by weight, and more preferably, 0.1 to 9 parts by weight with respect to 100 parts by weight of the binder resin.

A charge control agent can be added to the developing agent of the present invention.

Examples of this charge control agent are a nigrosine dye, chromium-containing complex, and quaternary ammonium salt. These charge control agents can be selectively used in accordance with the polarity of toner particles.

A charge control agent for use in the color developing agent is preferably colorless or light-colored so as not to have any influence on the color tone of toner. Examples are a salicylic acid metal salt and salicylic acid derivative metal salt (Bontron E84: Orient Corporation). A metal element to be used in this metal salt is preferably zirconium, zinc, chromium, boron complex, complex salt, or a mixture of these metal elements.

The addition amount of charge control agent is preferably 0.1 to 10 parts by weight, and more preferably, 0.2 to 7 parts by weight with respect to 100 parts by weight of the binder resin.

A fluidity imparting agent can be mixed in toner particles.

Examples of the fluidity imparting agent used in the present invention are fine particles of metal oxides such as silica, alumina, titania, magnesia, zirconia, ferrite, and magnetite, fine particles obtained by surface-treating or coating these fine particles with a processing agent such as a silane coupling agent, titanate coupling agent, zircoaluminate, quaternary ammonium salt, fatty acid, fatty acid metal salt, fluorine-based active agent, solvent, or polymer, fine particles of fatty acid and its metal salt such as stearic acid and zinc stearate, fine particles obtained by surface-treating these fine particles with any of the processing agents described above, fine particles of polymers such as polystyrene, polymethyl methacrylate, and polyvinylidene fluoride, and fine particles obtained by surface-treating or coating these fine particles with any of the above-mentioned processing agents. The average particle size of these fluidity imparting agents is favorably 0.01 to 3 μm.

The addition amount of fluidity imparting agent is preferably 0.1 to 7.0 parts by weight, and more preferably, 0.2 to 5.0 parts by weight with respect to 100 parts by weight of toner particles.

The fluidity imparting agent is mixed in toner particles by adhering the fluidity imparting agent to the surfaces of the toner particles by rapidly moving the powder in a fluid state by an air stream or mechanical force without substantially causing any pulverization. As the mixer, it is possible to use a high-speed fluid mixer such as a Henschel mixer or UM mixer.

The developing agent according to the present invention can be manufactured by various known methods or combinations of these methods.

For example, when kneading and pulverization are used, a binder resin, a coloring material such as carbon black, and necessary additives are mixed in a dry state, and the mixture is heated, melted, and kneaded by using an extruder, twin roll, or triple roll. After being cooled and set, the kneaded product is pulverized by a pulverizer such as a jet mill, and the pulverized product is classified by an air classification machine, thereby obtaining toner particles.

It is also possible to manufacture toner particles directly from a monomer, a coloring material, and additives by using suspension polymerization or nonaqueous dispersion polymerization.

The developing agent of the present invention can be used as a two-component developing agent containing toner which contains toner particles, and a carrier.

As the carrier, it is possible to use a magnetic material such as an iron powder, oxidized iron powder, ferrite, or nickel.

It is also possible to preferably use a resin-coated carrier obtained by coating any of these magnetic materials as a core with a resin. The particle size of the core material is 20 to 500 μm, preferably, about 30 to 300 μm.

A resin composition used as the carrier coating contains a releasable resin. As this releasable resin, it is possible to preferably use, e.g., a silicone resin or its modified product. Examples of the silicone resin, e.g., a straight silicone resin are KR271, KR255, and KR251 (Shin-Etsu Chemical), and SR2400 and SR2406 (Toray Silicone). Examples of the modified silicone resin are KR206 (an alkyd resin modified product), KR3093 (an acrylic resin modified product), ES1001N (an epoxy resin modified product) (Shin-Etsu Chemical), and SR2115 (an epoxy resin modified product) and SR2110 (an alkyd resin modified product) (Toray Silicone).

The use amount of releasable resin as described above is preferably about 0.1 to 50 parts by weight, and more preferably, 0.5 to 30 parts by weight per 100 parts by weight of the carrier core.

A conductive material is preferably added to the resin composition used as the carrier coating. Carbon black is favorably used as this conductive material. Examples of the carbon black are Black Pearls 2000, Vulcanxc-72 (Cabot), ketjen black EC•DJ500 and ketjen black EC•DJ600 (LION AKZO), Denka black particles and Denka black powder (Denki Kagaku Kogyo), and Conductex975 and Conductex SC (Columbia Carbon).

The addition amount of conductive material is preferably 0.05 to 70 parts by weight, and more preferably, 0.1 to 50 parts by weight with respect to 100 parts by weight of the releasable resin. A silane coupling agent can be added to the resin composition in order to improve the coating power of the coating layer or improve the dispersibility of the conductive material.

The carrier particle surfaces can be coated with the resin coating composition by means such as a spray method or dipping method.

The developing agent of the present invention can be used in combination with a fixing apparatus having a heating roller, a peeling roller separated from the heating roller, a fixing belt looped between the heating roller and peeling roller, and a pressure roller capable of pressing the heating roller via the fixing belt.

To improve the color reproducibility of a fixed developing agent image, a developing agent having a relatively low softening point is used as the developing agent of the present invention. This developing agent easily causes offset to a fixing member. In this fixing apparatus, however, a transfer medium is separated from the fixing belt. Therefore, a phenomenon in which the developing agent transfers to the fixing belt, i.e., high-temperature offset, can be inhibited without coating the fixing belt with any silicone oil, or by coating the fixing belt with only a very small amount of oil. Also, no scratch is formed on a fixed image unlike in a conventional fixing apparatus including a peeling claw. An elastic layer 64 of a fixing belt 54 makes it possible to evenly fix a developing agent image and improve the quality of the fixed developing agent image.

The present invention can also provide an image forming apparatus including a developing unit which contains the black developing agent and color developing agents described above, and the aforementioned fixing apparatus.

FIG. 1 is a schematic view showing an example of the fixing apparatus to which the developing agents of the present invention are applicable.

As shown in FIG. 1, this fixing apparatus has a fixing roller 52, a peeling roller 53, an endless fixing belt 54 looped between at least these two rollers, and a pressure roller 55 capable of pressing the fixing roller 52 and rotatable in synchronism with the fixing roller 52 via the fixing belt 54.

In this apparatus, a separation roller 70 is pressed against the peeling roller 53 via the fixing belt 54. A recording material P carrying an unfixed toner image T is fed into a pressing portion between the fixing roller 52 and pressure roller 55, such that the toner image comes into contact with the heated belt 54. The recording material P passing through this pressing portion is conveyed in close contact with the fixing belt 54 and fed into a pressing portion between the pressing means and the peeling roller 53. The recording material P passing through this pressing portion between the pressing means and the peeling roller 53 can be separated from the fixing belt 54.

The fixing roller 52 is made up of, e.g., a hollow cylindrical metal thin-walled roller 56 containing a heating member and made of aluminum, carbon steel, or stainless steel, and an elastic heat-insulating foamed layer 58 formed around the thin-walled roller 56.

The pressure roller 55 is made up of, e.g., a core metal 60, an elastic heat-insulating foamed layer 61 formed around the core metal 60, and a releasing layer 62 coating the foamed layer 61. Heat-insulating foamed silicone rubber can be used as the foamed layer 61, and a PFA tube can be used as the releasing layer 62.

As the peeling roller 53, a roller obtained by forming an elastic heat-insulating foamed layer 65 around a core metal 64 can be used. The outside diameter of this roller is, e.g., 20 mm.

The fixing belt 54 has, e.g., a sheet base and releasing layer. An elastic layer or the like can be formed between the sheet base and releasing layer if necessary. As the sheet base, it is possible to use an endless belt-like base made of, e.g., a heat-insulating resin and metal. Examples of the heat-insulating resin are polyimide, polyamidoimide, and polyetherketone (PEEK), and examples of the metal are nickel, aluminum, and iron. The thickness of the sheet base is desirably 100 μm or less. The releasing layer is preferably made of a material superior in heat resistance and durability. Examples are a fluorine-based resin and highly releasable silicone rubber.

The releasing layer can be formed by coating the surface of the sheet base or elastic layer with a fluorine resin by spraying or the like, and thermally fusing the fluorine resin. A highly releasable silicone rubber layer preferably has a rubber hardness of 25° to 65° (JIS A hardness meter).

The total thickness of the fixing belt 54 is preferably 100 to 300 μm. When the total thickness falls within this range, good fixing properties and high thermal response can be obtained. More specifically, it is possible to use a fixing belt having a structure in which 50-μm thick polyimide is used as a sheet base, and a 200-μm thick silicone rubber layer is formed as an elastic layer and coated with 18-μm thick Teflon™ as a releasing layer 25.

In the fixing apparatus shown in FIG. 1, elastic layers can be formed on the fixing roller, pressure roller, and transfer belt where necessary. By properly adjusting the pressing forces of these elastic layers, a matte, highly writeable image can be obtained.

In the developing unit, a black developing agent and color developing agents, e.g., yellow, magenta, and cyan developing agents can be contained in different developing devices. One or more image carriers can be used. A plurality of developing devices can be opposed to one image carrier. It is also possible to use a plurality of image carriers and oppose one developing device to each image carrier. In addition, a rotatable developing apparatus can be obtained by combining arbitrary ones of a plurality of developing devices containing the black developing agent and color developing agents. An example is a developing unit in which a rotatable developing apparatus including developing devices containing the color developing agents and a black developing device different from this developing apparatus are opposed to one image carrier. When image formation is performed in black mode by using this developing unit, the black developing device need only be operated, so low-cost, high-speed printing can be performed. Also, since the black developing device is separated from the developing devices containing the color developing agents, the black developing agent does not easily mix in the color developing agents.

Figure 2:
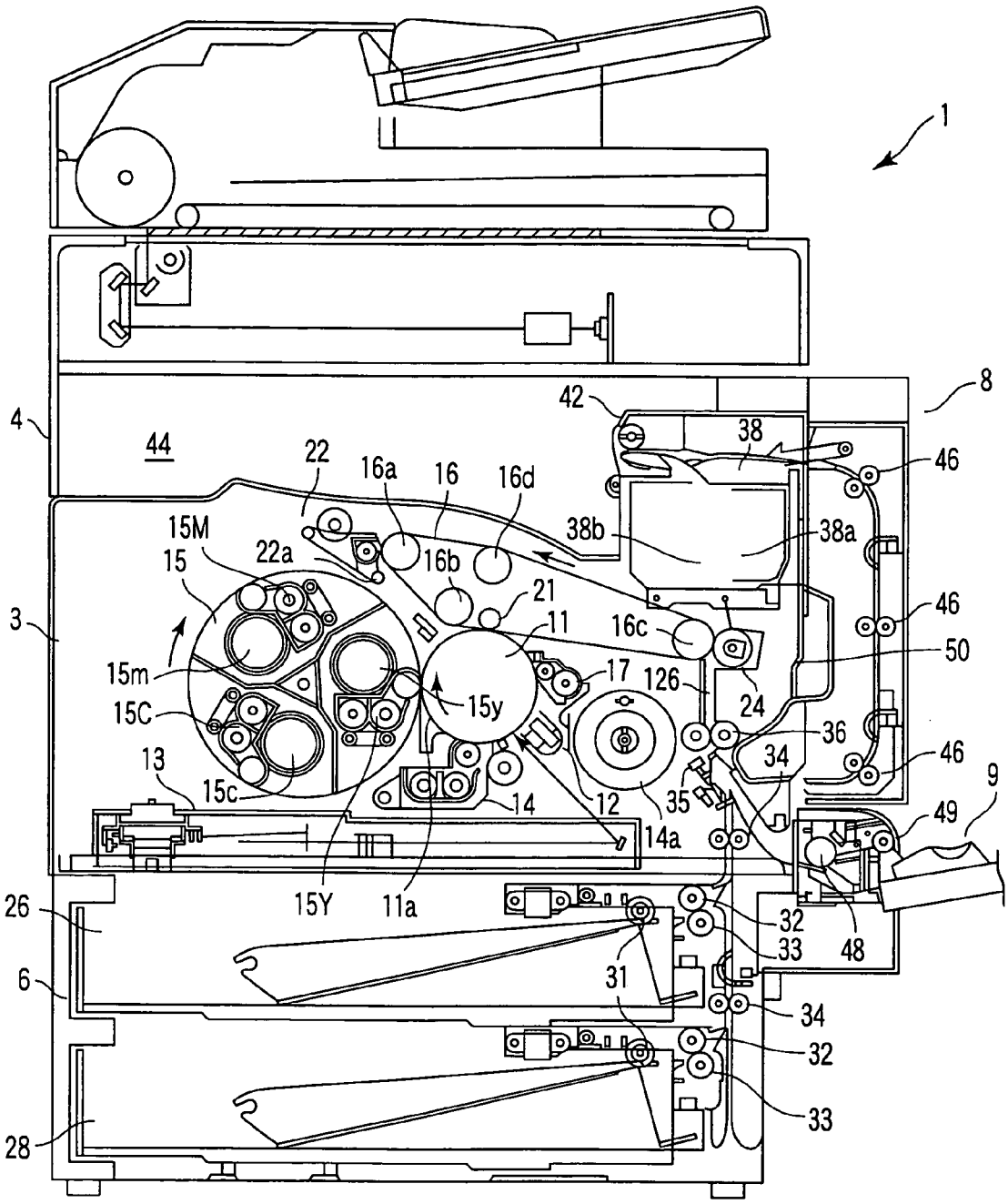
FIG. 2 is a schematic view showing an example of an image forming apparatus of the present invention.

FIG. 2 is a schematic view showing a revolver type image forming apparatus as an example of the image forming apparatus of the present invention.

An image forming apparatus 1 has a housing 3 which houses various units. A double-sided unit 8 and manual feed unit 9 are detachably attached to the side surface, in FIG. 2, of the housing 3. The double-sided unit 8 reverses a paper sheet P on one surface of which an image is formed by a process unit 4, and supplies the paper sheet P to the process unit 4 again. The manual feed unit 9 allows a user to manually feed a paper sheet P to the process unit 4.

More specifically, the process unit 4 has a photosensitive drum 11 (image carrier) having a tube axis in the front-rear direction (the direction perpendicular to the paper) of the color copying machine 1. Around the photosensitive drum 11, a charger 12, exposing device 13, black developing device 14 (second developing device), revolver 15 (developing unit), intermediate transfer belt 16 (intermediate transfer medium), and drum cleaner 17 (cleaning device) are arranged along the rotational direction (indicated by an arrow in FIG. 2) of the photosensitive drum 11. The photosensitive drum 11 must have a diameter of at least 50 mm or more in order to allow these devices to be arranged around it.

The charger 12 charges an outer circumferential surface 11*a* (to be referred to as a drum surface 11*a* hereinafter) of the photosensitive drum 11 to a predetermined potential. The exposing device 13 is positioned near the lower end of the process unit 4, and exposes the drum surface 11*a* which is charged to the predetermined potential, thereby forming an electrostatic latent image based on image data. To form a color image, the exposing device 13 exposes the drum surface 11*a* on the basis of color-separated image data, thereby forming electrostatic latent images of different colors on the drum surface 11*a*.

The black developing device 14 is placed between the photosensitive drum 11 and exposing device 13, i.e., opposes the photosensitive drum 11 from below in the direction of gravity. The black developing device 14 supplies a black developing agent to an electrostatic latent image for black formed on the drum surface 11*a* by the exposing device 13 and develops this electrostatic latent image, thereby forming a black developing agent image on the drum surface 11*a*. The black developing device 14 has a mixer for agitating and supplying the developing agent, and a developing roller opposed to the drum surface 11*a* with a predetermined development gap between them. The black developing device 14 is movable so that the developing roller is brought into contact with and separated from the drum surface 11*a*. The developing agent is supplied from a toner cartridge 14*a* to the black developing device 14.

The revolver 15 is rotatably placed adjacent to the left side, in FIG. 2, of the photosensitive drum 11. The revolver 15 has a yellow developing device 15Y (first developing device), magenta developing device 15M (first developing device), and cyan developing device 15C (first developing device) each of which has basically the same structure as the black developing device 14. These developing devices are arranged in the rotational direction of the revolver 15, and detachably contained in the revolver 15. Also, these developing devices have toner cartridges 15*y*, 15*m*, and 15*c* containing developing agents of the individual colors. When the revolver 15 is rotated clockwise, the developing devices 15Y, 15M, and 15C of different colors are selectively opposed to the drum surface 11*a* from the side of the photosensitive drum 11.

Since the use frequency of the black developing device 14 is higher than those of the developing devices of the other colors, the black developing device 14 is separated from the revolver 15 containing the developing devices of the other colors. Accordingly, the developing agent containing amounts of the black developing device and its toner cartridge can be made different from those of the developing devices of the other colors. This makes it possible to reduce the number of times of maintenance such as toner replenishment.

As described above, the black developing device 14 and revolver 15 are positioned outside an area above the photosensitive drum 11 in the direction of gravity. This prevents the developing agents undesirably scattering from the developing devices 14, 15Y, 15M, and 15C from falling on the photosensitive drum 11.

The intermediate transfer belt 16 is brought into rolling contact with the photosensitive drum 11 from above in the direction of gravity. The intermediate transfer belt 16 is extended as it is wound on a driving roller 16*a*, transfer pre-roller 16*b*, transfer counter roller 16*c*, and tension roller 16*d* each of which has a rotating axis extending in the front-rear direction. The driving roller 16*a* is fixed to the housing 3 in a position above the revolver 15. The transfer pre-roller 16*b* is fixed to the housing 3 in a position above the photosensitive drum 11. The transfer counter roller 16*c* is fixed in rolling contact with a conveying path (to be described later). The tension roller 16*d* is biased from the inside to the outside so as to give a predetermined tension to the intermediate transfer belt 16.

In addition, a primary transfer roller 21 is placed inside the intermediate transfer belt 16. The primary transfer roller 21 brings the intermediate transfer belt 16 into rolling contact with the drum surface 11*a*, and transfers a developing agent image formed on the drum surface 11*a* onto the intermediate transfer belt 16. The primary transfer roller 21 is biased toward the photosensitive drum 11 so as to press the intermediate transfer belt 16 against the drum surface 11*a* with a predetermined pressure.

The length of the intermediate transfer belt 16 is set to be exactly an integral multiple of the length of the outer circumference of the photosensitive drum 11. In other words, the length of the intermediate transfer belt 16 is so set that the same portion of the drum surface 11*a* is always in rolling contact with the same position. The length of the intermediate transfer belt 16 preferably exceeds at least the length of a longest paper sheet P, e.g., 431.8 mm. Since the diameter of the photosensitive drum 11 preferably exceeds at least, e.g., 50 mm, the length of the intermediate transfer belt 16 can be set to be a minimum necessary length, i.e., three times the outer circumferential length of the photosensitive drum 11.

Around the intermediate transfer belt 16, a belt cleaner 22 (cleaning device) and secondary transfer roller 24 (transfer device) are arranged such that they can be brought into contact with and separated from the belt surface. The belt cleaner 22 can be formed on the outer layer of the driving roller 16*a* via the intermediate transfer belt 16 in a position above the revolver 15. In other words, the belt cleaner 22 can be positioned outside the area above the photosensitive drum 11 in the direction of gravity. The secondary transfer roller 24 is placed in a position where the secondary transfer roller 24 and transfer counter roller 16*c* sandwich a vertical conveying path 126 (to be described later) via the intermediate transfer belt 16.

The drum cleaner 17 can be brought into contact with the photosensitive drum 11 from the right side in FIG. 2. In other words, the drum cleaner 17 can be positioned outside the area above the photosensitive drum 11.

The black developing device 14, revolver 15, drum cleaner 17, and belt cleaner 22 can be arranged outside the area above the photosensitive drum 11. Since the intermediate transfer belt 16 is positioned above the photosensitive drum 11, the developing agents undesirably scattering or leaking from the black developing device 14, revolver 15, drum cleaner 17, and belt cleaner 22 do not fall on the drum surface 11*a* and intermediate transfer belt 16. This prevents image degradation caused by adhesion of the developing agents.

A paper feed unit 6 has two, vertically stacked paper feed cassettes 26 and 28. On the upper right corner, in FIG. 2, of each of the paper feed cassettes 26 and 28, a pickup roller 31 for picking up the uppermost paper sheet P in the cassette is formed. On the downstream side in the paper picking direction of the pickup roller 31, a feed roller 32 and separation roller 33 are arranged in rolling contact with each other.

In a position adjacent to the right side, in FIG. 2, of each of the paper feed cassettes 26 and 28, the vertical conveying path 126 substantially vertically extends upward through a secondary transfer region in which the intermediate transfer belt 16 and secondary transfer roller 24 are in rolling contact with each other. On the vertical conveying path 126, a plurality of conveyor roller pairs 34 which clamp the paper sheet P and rotate, an aligning sensor 35 for sensing the arrival of the paper sheet P, and an aligning roller pair 36 for feeding the paper sheet P to the secondary transfer region at a predetermined paper feed timing are arranged upward in the order named toward the secondary transfer region.

On the vertical conveying path 126 further extending upward through the secondary transfer region, a fixing apparatus 38 by which a developing agent image transferred onto the paper sheet P is fixed by heat and pressure is placed. The fixing apparatus 38 has a heating roller 38*b* having a built-in heater, and a pressure roller 38*a* urged against the heating roller 38*b*. As the fixing apparatus 38, it is possible to apply, e.g., a fixing apparatus having the arrangement as shown in FIG. 1.

That is, in this apparatus, the vertical conveying path 126 extends on the side of the photosensitive drum 11 away from the revolver 15, i.e., on the right side, in FIG. 2, of the photosensitive drum 11. In other words, the vertical conveying path 126 extends outside an area below the black developing device 14, revolver 15, drum cleaner 17, and belt cleaner 22 in the direction of gravity. This makes it possible to prevent the developing agents undesirably scattering from the black developing device 14 and the developing devices 15Y, 15M, and 15C of the revolver 15 from falling on and adhering to the paper sheet P conveyed through the secondary transfer region, and prevent the developing agents undesirably leaking from the drum cleaner 17 and belt cleaner 22 from falling on and adhering to the paper sheet P.

Also, the use of the vertical conveying path 126 described above reduces the size of the whole construction of the color copying machine 1, and facilitates jam cleaning. That is, the longitudinal apparatus size is decreased by positioning the relatively large revolver 15 on the left side, in FIG. 2, of the photosensitive drum 11, and the convey path of the paper sheet P is shortened by the vertical conveying path 126. As a consequence, the size of the whole apparatus can be decreased. In addition, the vertical conveying path 126 near the secondary transfer region can be easily exposed outside the housing 3 by opening the double-sided unit 8 and a secondary transfer unit 50. This facilitates jam cleaning even if a paper jam occurs near the secondary transfer region.

The image forming operation by the color copying machine 1 described above will be explained below.

As an initial operation, the black developing device 14 is moved down and separated from the drum surface 11*a*, and the revolver 15 is rotated clockwise to oppose the yellow developing device 15Y to the drum surface 11*a*. Also, the belt cleaner 22 is rotated counterclockwise around an axis 22*a* and separated from the intermediate transfer belt 16. In addition, the secondary transfer roller 24 is moved (to the right in FIG. 2) away from the vertical conveying path 126 and separated from the intermediate transfer belt 16.

Image data is read from an original (not shown) by a scanner unit 2, or input from an external apparatus (not shown). The photosensitive drum 11 is rotated clockwise, and the charger 12 evenly charges the drum surface 11*a* to a predetermined potential. At the same time, the intermediate transfer belt 16 is rotated counterclockwise.

Furthermore, on the basis of color-separated yellow image data, the exposing device 13 operates and forms an electrostatic latent image for yellow on the drum surface 11*a*. The exposure timing is acquired by detecting a detection mark (not shown) adhered to the inside of the intermediate transfer belt 16 by a detector (not shown).

Subsequently, the yellow developing device 15Y supplies the yellow developing agent to the electrostatic latent image on the drum surface 11*a*, and this electrostatic latent image for yellow is developed to form a yellow developing agent image on the drum surface 11*a*. This yellow developing agent image thus formed on the drum surface 11*a* is moved by the rotation of the photosensitive drum 11 and passed through the first transfer region in rolling contact with the intermediate transfer belt 16.

In this state, a bias having a polarity opposite to that of the potential of the yellow developing agent image is given via the primary transfer roller, thereby transferring this yellow developing agent image on the drum surface 11*a* onto the intermediate transfer belt 16. When the length of the intermediate transfer belt 16 is set to be an integral multiple of the outer circumferential length of the photosensitive drum 11, developing agent images are transferred from the drum surface 11*a* onto the same position of the intermediate transfer belt 16.

After the yellow developing agent image is transferred onto the intermediate transfer belt 16, the yellow developing agent not transferred but remaining on the drum surface 11*a* is removed by the drum cleaner 17. At the same time, the residual electric charge on the drum surface 11*a* is also removed.

To prepare for the formation of a next electrostatic latent image for magenta on the drum surface 11*a*, the charger 12 evenly charges the drum surface 11*a*, and the revolver 15 is rotated to oppose the magenta developing device 15M to the drum surface 11*a*.

In this state, the above-mentioned series of processes, i.e., exposure→development→transfer onto intermediate transfer belt 16 are performed. Consequently, a magenta developing agent image is transferred and overlaid on the yellow developing agent image on the intermediate transfer belt 16. After the magenta developing agent image is thus transferred, a cyan developing agent image is similarly transferred and overlaid.

Then, the revolver 15 is rotated to a home position where none of the developing devices 15Y, 15M, and 15C opposes the drum surface 11*a*. Instead, the black developing device 14 is moved up and opposed to the drum surface 11*a*. In this state, the same processes as above are executed to transfer and overlay a black developing agent image onto the yellow, magenta, and cyan developing agent images on the intermediate transfer belt 16.

When the developing agent images of all the colors are thus overlaid on the intermediate transfer belt 16, the secondary transfer roller 24 is moved to the left in FIG. 2 and brought into rolling contact with the intermediate transfer belt 16, and the belt cleaner 22 is also brought into contact with the intermediate transfer belt 16. In this state, the developing agent images of all the colors overlaid on the intermediate transfer belt 16 are moved by the rotation of the intermediate transfer belt 16, and passed through the secondary transfer region between the intermediate transfer belt 16 and secondary transfer roller 24.

Simultaneously, a paper sheet P picked up from the cassette 26 or 28 by the pickup roller 31 is conveyed upward through the vertical conveying path 126 by the conveyor roller pair 34. After being aligned by the aligning roller 36, the paper sheet P is fed to the secondary transfer region at a predetermined timing.

A bias having a polarity opposite to that of the potential of the individual color developing agent images is applied via the secondary transfer roller 24, thereby transferring these color developing agent images on the intermediate transfer belt 16 onto the paper sheet P. After the developing agent images are thus transferred onto the paper sheet P, the belt cleaner 22 removes the developing agents remaining on the intermediate transfer belt 16.

The paper sheet P onto which the individual color developing agent images are simultaneously transferred is then heated and pressed by the fixing apparatus 38. Consequently, the color developing agent images are fixed on the paper sheet P to form a color image. The paper sheet P on which the color image is thus formed is discharged onto a paper discharge tray 44 via a paper discharge roller 42 formed downstream of the fixing apparatus 38. The paper discharge tray 44 can be formed inside the housing 3.

In this revolver type image forming apparatus as described above, the black developing device and the color developing devices are separately arranged. Therefore, when no color image is to be formed, i.e., in black mode, the black developing device 14 need only be operated. This is favorable to high-speed printing.

Also, in this apparatus, black development is performed first, and then color development is performed. On the intermediate transfer medium, a black developing agent image and color developing agent images are stacked in this order. When these images are transferred onto a recording medium, e.g., a paper sheet, the color developing agent images and black developing agent image are transferred in this order onto the transfer medium. That is, the black developing agent image is stacked on the color developing agent images. This realizes clear black character images. Since the black developing device and color developing devices are separately arranged, the image forming speed in black mode can be increased.

The revolver type image forming apparatus described above is an example of the present invention, so the image forming apparatus of the present invention is not limited to this apparatus. That is, the present invention also includes an image forming apparatus in which Y, M, C, and K toner components are contained in one developing device.

The present invention will be described in more detail below by way of examples.

Note that "parts" represents "parts by weight" in examples and comparative examples.

EXAMPLE 1

Black toner, yellow toner, magenta toner, and cyan toner were formed by using the following developing agent compositions.

Toner Set A

| Black toner composition | | |
|---|---|---|
| Binder resin | Polyester resin | acidic value 20<br>softening point 119° C.<br>100 parts<br>weight-average molecular weight 31,000<br>number-average molecular weight 2,800 |

-continued

| | | |
|---|---|---|
| Coloring material | Carbon black | 7 parts |
| Wax 1 | Carnauba wax | melting point 83° C.<br>2 parts |
| Wax 2 | PP wax | melting point 145° C.<br>5 parts |
| CCA | Zr metal complex | 1 part |
| | Color toner composition | |
| Binder resin | Polyester resin | acidic value 10<br>softening point 120° C.<br>100 parts<br>weight-average molecular weight 45,000<br>number-average molecular weight 3,000 |
| Coloring material | One of pigments for Y, M, and C | 8 parts |
| Wax 1 | Rice wax | melting point 79° C.<br>2 parts |
| Wax 2 | PP wax | melting point 145° C.<br>5 parts |
| CCA | Zr metal complex | 1 part |

The above materials were mixed by using a Henschel mixer and melted and kneaded by a biaxial extruder. The obtained molten kneaded product was cooled, coarsely pulverized by a hammer mill, finely pulverized by a jet pulverizer, and classified, thereby obtaining toner particles having a volume-average diameter of 9 μm. Toner was manufactured by mixing 2.5 parts of hydrophobic silica and 0.5 parts by weight of hydrophobic titanium oxide in 100 parts of the obtained toner particles.

Coating solutions were prepared by the following formulas as carrier coating materials.

| | |
|---|---|
| First layer composition | |
| Silane coupling agent | 100 parts |
| Second layer composition | |
| Silicone resin solution (Toray Silicone SR2406, solid component 20%) | 500 parts |
| Conductive ketjen black EC (Lion Akzo) | 4.0 parts |
| Toluene | 1,500 parts |

10 kg of a ferrite carrier having an average particle size of 40 μm were placed in a rotary disk-like fluid particle coating apparatus. While the ferrite carrier was fluidized, the coating solution of the first layer formula described above was sprayed together with nitrogen gas at room temperature, thereby coating a first layer.

After that, the coating solution of the second layer formula was dusted at a temperature of 80° C. The obtained particles were extracted from the coating apparatus and placed in a constant-temperature bath. The particles were heated at 200° C. for 2 hours to harden the silicone film, thereby coating a second layer. The resultant material was named a carrier A.

The carrier A was mixed in 8 parts of each of the obtained toner components of different colors such that the total amount was 100 parts, thereby forming two-component developing agents.

A fixing device having the same arrangement as shown in FIG. 1, except that a fixing roller 40 mm in diameter obtained by forming a 0.1-mm thick rubber layer having a hardness of 95° on a core metal and a pressure roller 40 mm in diameter obtained by forming a sponge layer having a hardness of 55° on a core metal were used, was set in the fixing device portion of the image forming apparatus shown in FIG. 2.

The obtained two-component developing agents were placed in developing devices of predetermined colors, and image formation was performed by copying a specific copy chart or printing out image data supplied from a connected PC.

The fixing device was set under the following conditions.

The pressing force of the pressure roller with respect to the fixing roller was 700 N, and the fixing roller was made settable at 160° C. by a thermistor in contact with the fixing roller. The pressing force was finely adjusted such that the nip width of the pressure roller with respect to the fixing belt was 6 mm. A belt was looped between the fixing roller and peeling roller. The fixing speed was set at 200 mm/sec.

The two-component developing agents described above were applied to this image forming apparatus, and the fixing properties, offset resistance, smear resistance, charging characteristics, life charge, reproducibility (color difference), glossiness, scratch, and writeability of these developing agents were tested and evaluated.

The toner sets, carriers, and fixing devices used are shown in Table 1 (to be presented later).

The obtained results are shown in Table 2 (to be presented later).

The tests and evaluations were done as follows.

The fixing property test was conducted as follows. The development amount was so adjusted that the toner development amount was 0.9 mg/cm$^2$, and images were sampled by changing the fixing temperature in 5° C. increments from 100 to 200° C. After the image density was measured, each image was rubbed by a 100% cotton pad by using a fastness tester, and the image density was measured again. The ratio of this image density to the image density before the image was rubbed was calculated.

If the differences between the fixing strengths of the toners of the four colors were less than 5%, the evaluation was ○; if the differences between the fixing strengths of the toners of the four colors were 5% (inclusive) to 10% (exclusive), the evaluation was Δ; if the differences between the toner strengths of the toners of the four colors were 10% or more, the evaluation was X.

The offset resistance test was conducted as follows. A toner image was transferred and fixed by the fixing device under the conditions described above, and whether contamination by the toner occurred was observed. This operation was performed by raising the fixing temperature step by step, and low-temperature offset occurring in a low-temperature region was measured.

If the low-temperature offsets of the toners of the four colors were 130° C.±less than 5° C., the evaluation was ○; if the low-temperature offsets of the toners of the four colors were 130° C.±5° C. (inclusive) to 10° C. (exclusive), the evaluation was Δ; if the low-temperature offsets of the toners of the four colors were 130° C.±10° C. or more, the evaluation was X.

The smear resistance test was conducted by rubbing a copied image fixed on a copying sheet against another unused copying sheet, and ranking the observed contamination of the unused copying sheet. Note that the smear level was an average value within a non-offset temperature range.

If the smear level differences between the toners of the four colors were less than 3, the evaluation was ○; if the smear level differences between the toners of the four colors were 3 (inclusive) to 5 (exclusive), the evaluation was Δ; if the smear level differences between the toners of the four colors were 5 or more, the evaluation was X.

The charging characteristic test was conducted by measuring the initial charge amount and the charge amount after 1K image output by using a suction type blow-off charge amount meter (#TB-220), and calculating the difference.

If the differences between the initial charge amounts of the toners of the four colors were less than 3 μC/g, the evaluation was ○; if the differences between the initial charge amounts of the toners of the four colors were 3 (inclusive) to 5 (exclusive) μC/g, the evaluation was Δ; if the differences between the initial charge amounts of the toners of the four colors were 5 μC/g or more, the evaluation was X.

The life charge was evaluated by calculating the difference between the initial charge amount and the charge amount after 30K image output. If the differences between the charge amounts after 30K image output of the toners of the four colors were less than 5 μC/g, the evaluation was ○; if the differences between the charge amounts after 30K image output of the toners of the four colors were 5 (inclusive) to 10 (exclusive) μC/g, the evaluation was Δ; if the differences between the charge amounts after 30K image output of the toners of the four colors were 10 μC/g or more, the evaluation was X.

The image reproducibility (color difference) was evaluated by performing image output by copying a Japan color chart sheet as an original, and calculating the color difference by an X-Rite spectrometer (manufactured by X-Rite). If the color differences between the original and the initial images of the toners of the four colors were less than 3, the evaluation was ○; if the color differences between the original and the initial images of the toners of the four colors were 3 (inclusive) to 10 (exclusive), the evaluation was Δ; if the color differences between the original and the initial images of the toners of the four colors were 10 or more, the evaluation was X.

The glossiness of an image was evaluated as follows. 25 mm×25 mm solid images were output such that the development amount was 0.9 mg/cm$^2$ for monochromatic images and 1.5 mg/cm$^2$ for four-color images. The glossiness of a portion on which the toner was fixed was measured by a digital precision glossmeter (Murakami Color Research Laboratory K.K.). If the glossiness differences between the original and the initial images of the toners of the four colors were less than 3, the evaluation was ○; if the glossiness differences between the original and the initial images of the toners of the four colors were 3 (inclusive) to 10 (exclusive), the evaluation was Δ; if the glossiness differences between the original and the initial images of the toners of the four colors were 10 or more, the evaluation was X.

The occurrence of scratch was evaluated by visually checking the presence/absence of scratch occurring when a solid image was output and the transfer medium was separated from the fixing member.

If no scratch was found when a solid image was output, the evaluation was ○; if scratch was found when a solid image was output, the evaluation was X.

The writeability was evaluated as ○ if writing with a pencil was possible on an output solid image, and as X if writing with a pencil was impossible on an output solid image.

Table 1 (to be presented later) shows the results of these tests and evaluations.

EXAMPLE 2, COMPARATIVE EXAMPLES 1 & 2

Figure 3:
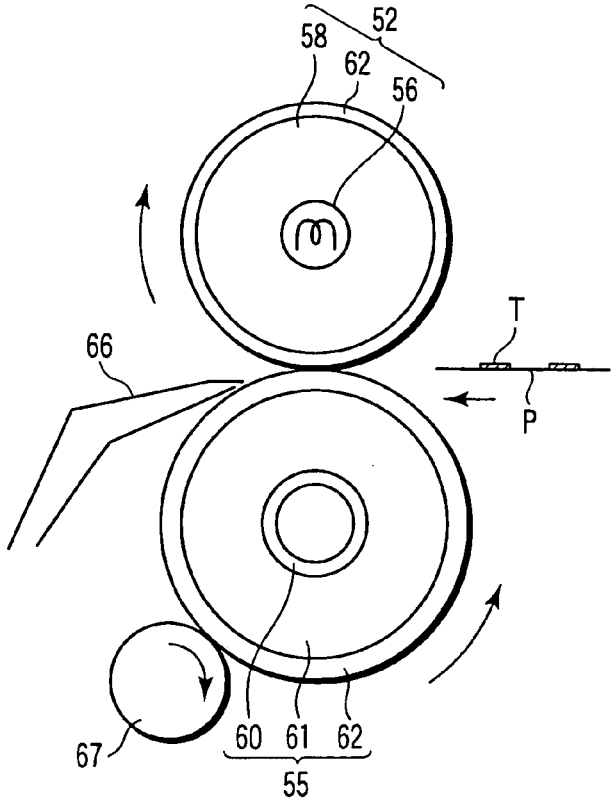
FIG. 3 is a schematic view showing an example of a fixing apparatus including a peeling claw.

A fixing device having the same arrangement as in Example 1 except that a fixing roller, peeling claw, and oil supply roller were used instead of the fixing belt and peeling roller. FIG. 3 shows an outline of the fixing device used.

As shown in FIG. 3, this fixing device has a rotatable fixing roller 52, a pressure roller 55 capable of pressing the fixing roller 52 and rotatable in synchronism with the fixing roller 52, and a peeling claw 66 and silicone oil supply member 67 arranged on the paper discharge side of the pressure roller 55.

A fixing device having the arrangement shown in FIG. 3 was set in the fixing device portion of the image forming apparatus shown in FIG. 2. The pressing force of the pressure roller with respect to the fixing roller was set at 700 N, and the fixing roller was made settable at 160° C. by a thermistor in contact with the fixing roller. The fixing speed was set at 200 mm/sec.

Black toner, yellow toner, magenta toner, and cyan toner were formed by using the following toner compositions.

| Toner set B | | |
|---|---|---|
| Black developing agent composition | | |
| Binder resin | Polyester resin | acidic value 10<br>softening point 120° C.<br>100 parts |
| | weight-average molecular weight 45,000<br>number-average molecular weight 3,000 | |
| Coloring material | Carbon black | 7 parts |
| Wax 1 | Carnauba wax | melting point 83° C.<br>2 parts |
| Wax 2 | PP wax | melting point 145° C.<br>5 parts |
| CCA | Zr metal complex | 1 part |
| Color developing agent composition | | |
| Binder resin | Polyester resin | acidic value 20<br>softening point 119° C.<br>100 parts |
| | weight-average molecular weight 31,000<br>number-average molecular weight 2,800 | |
| Coloring material | One of pigments for Y, M, and C | 8 parts |
| Wax 1 | Rice wax | melting point 79° C.<br>2 parts |
| Wax 2 | PP wax | melting point 145° C.<br>5 parts |
| CCA | Zr metal complex | 1 part |

The above materials were used to manufacture toner B following the same procedures as in Example 1.

In addition, carrier coating was performed following the same procedures as in Example 1 except that no first layer was formed. The resultant carrier was named carrier B.

Two-component developing agents were formed following the same procedures as in Example 1 except that the toner B and carrier B described above and the toner A and carrier A of Example 1 were combined as shown in Table 1 below.

The obtained two-component developing agents were applied to an image forming apparatus including the fixing device shown in FIG. 1 or 3 as shown in Table 1, and the same tests and evaluations as in Example 1 were performed. The results are shown in Table 2 below.

TABLE 1

| | Toner set | Carrier | Fixing device |
|---|---|---|---|
| Example 1 | A | A | FIG. 1 |
| Comparative Example 1 | B | A | FIG. 1 |
| Comparative Example 2 | B | B | FIG. 3 |
| Example 2 | A | A | FIG. 3 |

TABLE 2

| | Fixing | Offset | Smear | Charging | Life charge | Image (color difference) | Image (glossiness) | Scratch | Write-ability |
|---|---|---|---|---|---|---|---|---|---|
| Example 1 | ○ | ○ | ○ | ○ | ○ | ○ | ○ | ○ | ○ |
| Comparative Example 1 | Δ | Δ | Δ | Δ | Δ | ○ | ○ | ○ | ○ |
| Comparative Example 2 | X | X | X | X | X | X | X | X | X |
| Example 2 | ○ | ○ | ○ | ○ | ○ | Δ | Δ | X | X |

As is apparent from Table 1, in color image formation using the developing agents each containing a polyester resin having an acidic value and wax components having melting points higher and lower than the softening point of this polyester resin, when the acidic value of the polyester resin of the black developing agent was higher than that of the polyester resin of the color developing agents as in Example 1, good results were obtained for all the fixing properties, offset resistance, smear resistance, charging characteristics, life charge, reproducibility (color difference), glossiness, scratch, and writeability. However, when the acidic value of the polyester resin of the black developing agent was lower than that of the polyester resin of the color developing agents as in Comparative Example 1, the fixing properties, offset resistance, smear resistance, and charging characteristics deteriorated. Also, as indicated by Example 2, when the heated roller type fixing device including a peeling claw was used instead of the fixing device including the fixing belt and peeling roller shown in FIG. 1, the reproducibility (color difference), glossiness, scratch, and writeability slightly deteriorated. Furthermore, all the characteristics deteriorated when the acidic value of the polyester resin of the black developing agent was lower than that of the polyester resin of the color developing agents and the heated roller type fixing device including the peeling claw was used.

Additional advantages and modifications will readily occur to those skilled in the art. Therefore, the invention in its broader aspects is not limited to the specific details and representative embodiments shown and described herein. Accordingly, various modifications may be made without departing from the spirit and scope of the general inventive concept as defined by the appended claims and their equivalents.

What is claimed is:

1. A developing agent to perform black development, which is used in combination with a color developing agent containing toner particles having (i) a chromatic coloring material, (ii) a first binder resin containing a polyester resin having a first acidic value, (iii) wax having a softening point higher than a softening point of the first binder resin, and (iv) wax having a softening point lower than the softening point of the first binder resin, the developing agent to perform black development comprising;

toner particles having a black coloring material, a second binder resin containing a polyester resin having a second acidic value higher than the first acidic value, wax having a softening point higher than a softening point of the second binder resin, and wax having a softening point lower than the softening point of the second binder resin.

2. A developing agent according to claim 1, wherein the polyester resin having the first acidic value and the polyester resin having the second acidic value have a softening point of 100 to 150° C.

3. A developing agent according to claim 1, wherein the first acidic value is 6 to 12 KOH mg/g, and the second acidic value is 12 to 29 KOH mg/g.

4. A developing agent according to claim 1, wherein the polyester resin having the first acidic value has a weight-average molecular weight of 5,000 to 90,000, and the polyester resin having the second acidic value has a weight-average molecular weight of 5,000 to 60,000.

5. A developing agent according to claim 1, wherein the polyester resin having the first acidic value has a number-average molecular weight of 2,000 to 5,000, and the polyester resin having the second acidic value has a number-average molecular weight of 2,000 to 4,000.

6. A developing agent according to claim 1, further containing carrier particles each having a silane-coupling-processed surface and a silicone resin layer coating the silane-coupling-processed surface.

7. A developing agent according to claim 6, wherein the silicone resin layer contains carbon.

8. A developing agent to perform color development, comprising:

toner particles having a chromatic coloring material, a first binder resin containing a polyester resin having a first acidic value, wax having a softening point higher than a softening point of the first binder resin, and wax having a softening point lower than the softening point of the first binder resin, wherein the coloring agent to perform color development is used in combination with a black developing agent containing toner particles having (i) black coloring material, (ii) a second binder resin containing a polyester resin having a second acidic value higher than the first acidic value, (iii) wax having a softening point higher than a softening point of the second binder resin, and (iv) wax having a softening point lower than the softening point of the second binder resin.

9. A developing agent according to claim 8, wherein the polyester resin having the first acidic value and the polyester resin having the second acidic value have a softening point of 100 to 150° C.

10. A developing agent according to claim 8, wherein the first acidic value is 6 to 12 KOH mg/g, and the second acidic value is 12 to 29 KOH mg/g.

11. A developing agent according to claim 8, wherein the polyester resin having the first acidic value has a weight-average molecular weight of 5,000 to 90,000, and the polyester resin having the second acidic value has a weight-average molecular weight of 5,000 to 60,000.

12. A developing agent according to claim 8, wherein the polyester resin having the first acidic value has a number-average molecular weight of 2,000 to 5,000, and the polyester resin having the second acidic value has a number-average molecular weight of 2,000 to 4,000.

13. A developing agent according to claim 8, further containing carrier particles each having a silane-coupling-processed surface and a silicone resin layer coating the silane-coupling-processed surface.

14. A developing agent according to claim 13, wherein the silicone resin layer contains carbon.

15. An image forming apparatus comprising: a developing unit which opposes an image carrier, which comprises a color developing agent containing toner particles having a chromatic coloring material, a first binder resin comprising a polyester resin having a first acidic value, wax having a softening point higher than a softening point of the first binder resin, and wax having a softening point lower than the softening point of the first binder resin, and a black developing agent comprising toner particles having a black coloring material, a second binder resin comprising a polyester resin having a second acidic value higher than the first acidic value, wax having a softening point higher than a softening point of the second binder resin, and wax having a softening point lower than the softening point of the second binder resin, and which forms a developing agent image by developing an electrostatic latent image formed on the image carrier; a transfer unit to transfer the developing agent image onto a transfer medium; and a fixing unit which has a heating roller, a peeling roller separated from the heating roller, a fixing belt looped between the heating roller and peeling roller, and a pressure roller capable of pressing the heating roller via the fixing belt, and which forms an image by fixing the transferred developing agent image onto the transfer medium.

16. An apparatus according to claim 15, wherein the image has a glossiness of not more than 10.

17. An apparatus according to claim 15, wherein the polyester resin having the first acidic value and the polyester resin having the second acidic value have a softening point of 100 to 150° C.

18. An apparatus according to claim 15, wherein the first acidic value is 6 to 12 KOH mg/g, and the second acidic value is 12 to 29 KOH mg/g.

19. An apparatus according to claim 15, wherein the polyester resin having the first acidic value has a weight-average molecular weight of 5,000 to 90,000, and the polyester resin having the second acidic value has a weight-average molecular weight of 5,000 to 60,000.

20. An apparatus according to claim 15, wherein the polyester resin having the first acidic value has a number-average molecular weight of 5,000 to 90,000, and the polyester resin having the second acidic value has a number-average molecular weight of 2,000 to 4,000.

21. An apparatus according to claim 15, further comprising carrier particles each having a silane-coupling-processed surface and a silicone resin layer coating the silane-coupling-processed surface.

22. An apparatus according to claim 21, wherein the silicone resin layer comprises carbon.

* * * * *